United States Patent [19]

Erthein

[11] 4,023,721

[45] May 17, 1977

[54] GARMENT CLAMPING HANGER WITH SPRING-BIASED CLAMPING MEMBERS

[76] Inventor: Marc Erthein, Newberry Road, East Haddam, Conn. 06423

[22] Filed: Sept. 25, 1975

[21] Appl. No.: 616,847

[52] U.S. Cl. ..... 223/96; 24/255 A; 24/67.5

[51] Int. Cl.[2] ..... A47J 51/14

[58] Field of Search ..... 223/91, 93, 96; 24/255, 24/255 A, 255 SL, 248 SL, 67.5, 67.9

[56] References Cited

UNITED STATES PATENTS

| | | | |
|---|---|---|---|
| 1,865,453 | 7/1932 | Baltzley | 24/255 A |
| 2,723,063 | 11/1955 | Carr | 223/91 |
| 2,805,013 | 9/1957 | Comfort | 223/96 |
| 3,191,823 | 6/1965 | Edwardes | 223/96 |
| 3,604,071 | 9/1971 | Reimels | 24/248 SL |
| 3,718,881 | 2/1973 | Szanny | 24/255 A |
| 3,767,092 | 10/1973 | Garrison et al. | 223/96 |

FOREIGN PATENTS OR APPLICATIONS

| | | | |
|---|---|---|---|
| 662,480 | 12/1951 | United Kingdom | 223/91 |

*Primary Examiner*—George H. Krizmanich
*Attorney, Agent, or Firm*—Alexander Mencher

[57] ABSTRACT

A clamping hanger having an arm and at least one pair of hinged clamping members having at least one member integrally formed with said arm for movement of the members between open and closed positions for holding and releasing a garment or the like therebetween. The gripping members are biased for intermediate and/or closed position by means of a springable locking clip secured to each of said members.

6 Claims, 10 Drawing Figures

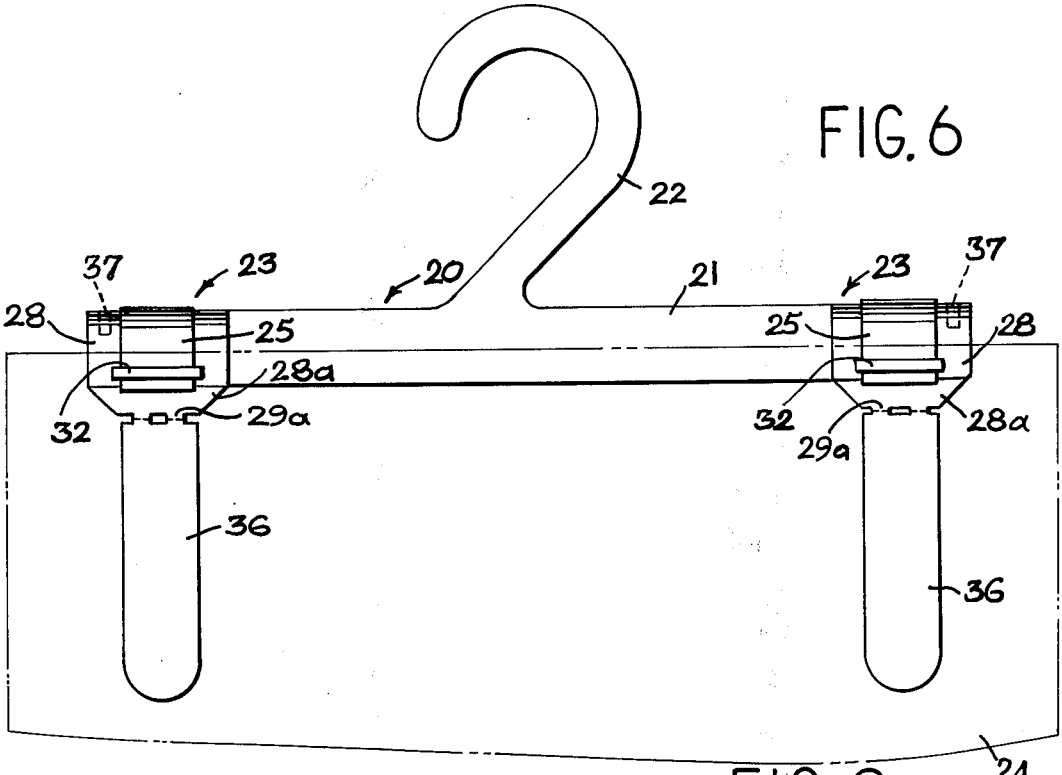
FIG. 6
FIG. 9
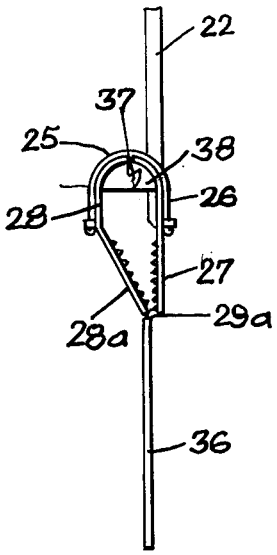
FIG. 7
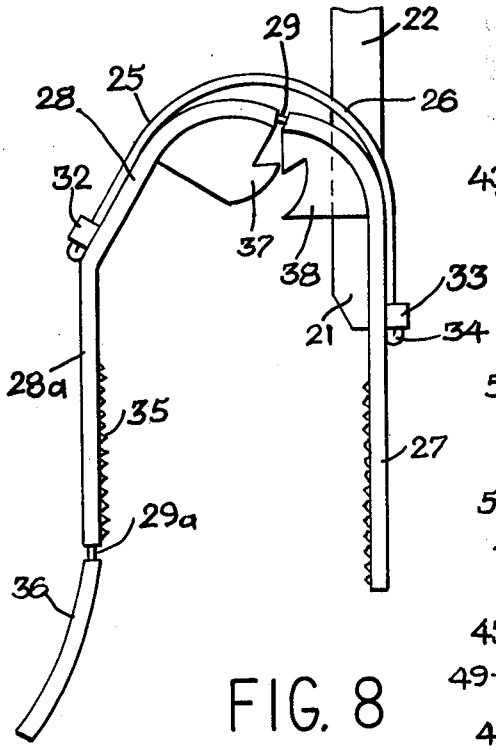
FIG. 8
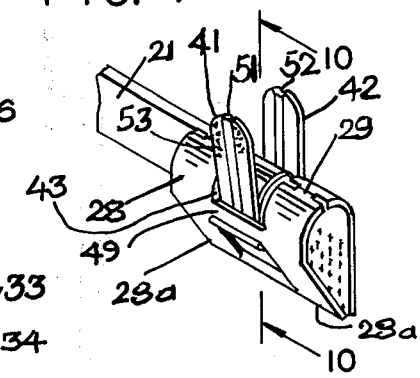
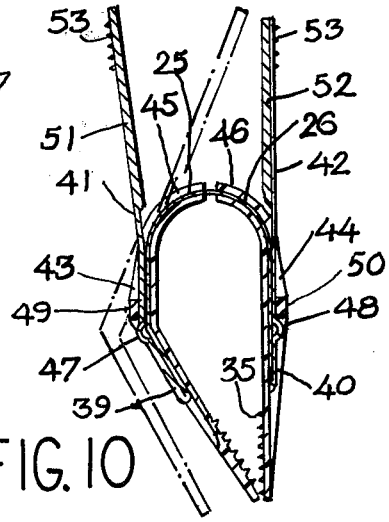
FIG. 10

GARMENT CLAMPING HANGER WITH SPRING-BIASED CLAMPING MEMBERS

BACKGROUND OF THE INVENTION

This invention relates generally to clamping hangers for garments and the like, and more particularly to a locking spring clip secured to each of the clamping members.

Clamping types of hangers are known to the art and various spring means are further known for yieldably locking the clamping members in closed position to retain garments or the like therebetween. However, there is no art known to the applicant herein wherein non-abrasive and non-metallic hinged clamping members are normally and relatively spring-biased for locking purposes by means of a springable locking clip attached to each of said members and away from the full path of movement of the movable clamping member when attaining any open position.

In another application filed concurrently herewith by applicant under the title Garment Clamping Hanger with Pivoted Locking Clip, the spring element is attached to an arm of the clamp and swingable away from the full path of movement of the movable clamping member when attaining any open position.

In the patent to Garrison et al., U.S. Pat. No. 3,767,092 dated Oct. 23, 1973, a slidable locking clip is utilized adapted to run in tracks of hinged clamping members and which is intended to be prevented from separation by a cross-bar stop member with the clip slidable therebeneath. In open position the clip of Garrison loosely projects above the top of the clamp, rattles and may be easily separated by being forced through the cross-bar on being snared or otherwise contacted in use. Moreover, the movable clamping member of Garrison tends to jam or separate the clip from the cross-bar when moved to fully open position, and further the mode of operation as by upward pushing thereof leads the user to confusion in operation.

Other patents of the prior art show hinged and clamping members molded of plastic as Loscalzo et al., U.S. Pat. No. 3,487,984 dated Jan. 6, 1970, Boyce, U.S. Pat. No. 3,526,935 dated Sept. 8, 1970 and Batts, U.S. Pat. No. 3,698,607 dated Oct. 17, 1972; but each fails to show any type of overlying or external spring-biasing. Moreover, patents on spring-biased metallic and non-metallic clamps are numerous including Cavanagh, U.S. Pat. No. 2,338,702 dated Jan. 11, 1944, and older patents as Seger, U.S. Pat. No. 648,534 dated May 1, 1900 Ashmore, U.S. Pat. No. 1,474,102 dated Nov. 13, 1923; but these also fail to show the mode of operation and simplicity of applicant's spring clip and as attached and overlying the hinged gripping members.

Accordingly, a main object of the invention is to provide a garment clamp of the type having a body or arm preferably integrally molded with one or more of the gripping members, but wherein the gripping members are hingedly molded and have an overlying springable clip inseparably secured to each of said gripping members and wherein the gripping members are relatively movable between locked and unlocked positions by finger engagable leverage means.

A further object of the invention is to provide a combination of clamp and spring clip wherein the overlying spring is outwardly flexed together with gripping member movement and is necessarily out of the path of movement of the gripping member at all times; wherein operation of said clip is self-evident to the user by virtue of common knowledge of lever operation.

Another object of the invention resides in the efficient and economical manner of assembling the spring clip to the hanger for non-separability, in the economy in cost of production for throw-away purposes of the hanger, in the positive and easy manner of attaining full or intermediate unlocking and locking position and in the means used to prevent accidental opening in the course of usage.

These objects and other incidental ends and advantages of the invention will hereinafter appear in the progress of the disclosure and as will be pointed out in the appended claims.

BRIEF DESCRIPTION OF THE DRAWINGS

FIG. 6 is a front view in elevation of another form of the invention;

FIG. 7 is a right side end view in elevation of FIG. 6 with the clamp and spring in closed and locked position;

FIG. 8 is an enlarged right side end view with the clamp and spring in an intermediate open position;

FIG. 9 is a view in perspective of another form of the invention; and

FIG. 10 is an enlarged cross-sectional view of FIG. 9 across the plane 10—10 thereof.

DESCRIPTION OF EMBODIMENTS OF THE INVENTION

Embodiment I

Figure 1:
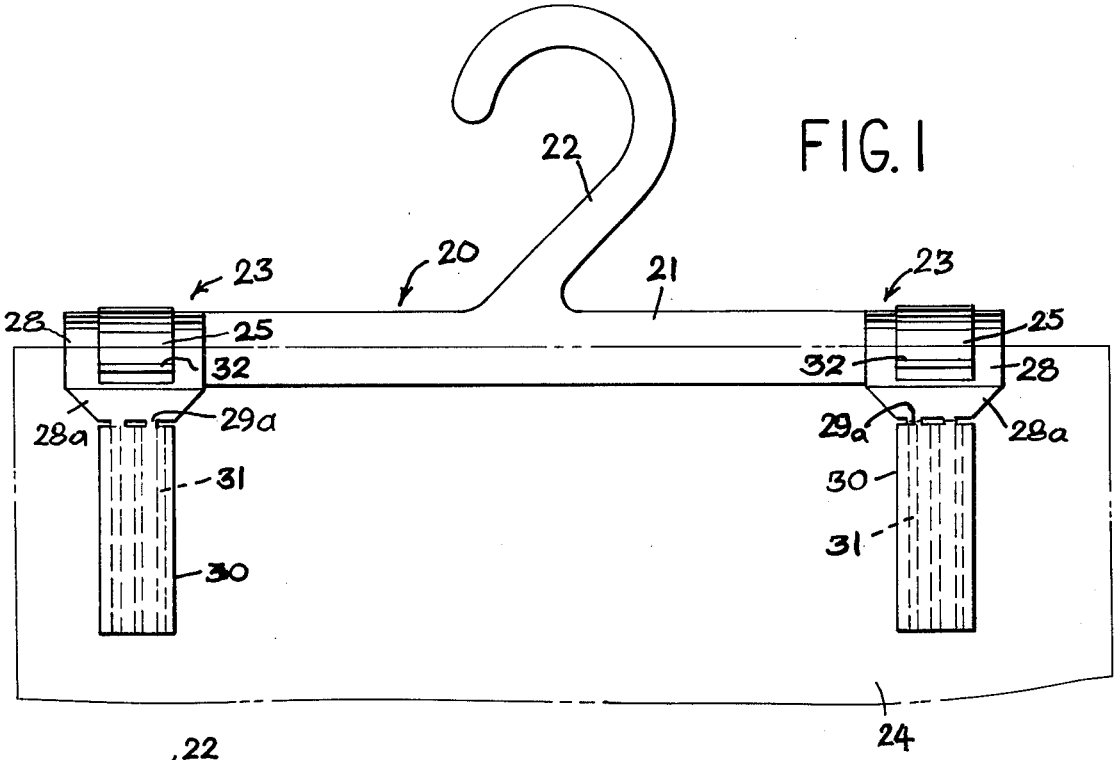
FIG. 1 is a front view in elevation of one form of the invention showing the clamp of the hanger in normally closed and locked position by the springable clip overlying and attached to the gripping members of the clamp.

In accordance with the invention and the preferred embodiments shown, the garment hanger illustrated in FIG. 1–5 and generally designated by numeral 20 comprises a body or arm 21, a hook 22 and a pair of similar spring-biased clamps each generally designated by numeral 23. A garment or the like such as a pair of slacks clamped in locked position is indicated in phantom as by numeral 24.

Attached to and overlying each of the clamps is a spring clip substantially U-shaped and having legs 25 and 26 and is adapted to bias the clamps 23 in normally locked position.

Each of the clamps 23 comprises a rear gripping member 27 and a front gripping member 28 joined at the top for hinged movement as by a web connection 29, the top portions of the gripping members adjacent the web being preferably rounded as shown in FIGS. 1–5.

Front gripping member 28 has a lower inwardly offset area **28*a* for various spacing purposes including compressibility by the flexing of spring clip when the gripping members 25 and 26 are separated for garment insertion and gripping as will appear. Moreover, the inner faces of gripping members 27 and 28** may have projections 35 for the usual friction gripping of garments locked therebetween.

For operation of each of the clamps 23, there is provided a hanging and relatively rigid hand-operable lever type of tab 30 and as shown hinged to the lower edge of front gripping member 28 as by a web connection 29*a*. Tab 30 may have raised and spaced vertical ribs 31 on the rear side to effect or increase rigidity thereof for proper operation as will appear.

The spring legs 25 and 26 are suitably attached intermediate the width of the gripping members for overlying and biasing said members as by the use of retaining loops 32 and 33 on the outer faces of gripping members 28 and 27. For this purpose, each of the spring legs at the lower edges is outwardly turned as at 34 to serve as stops against detachment in conjunction with said loops.

Figure 2:
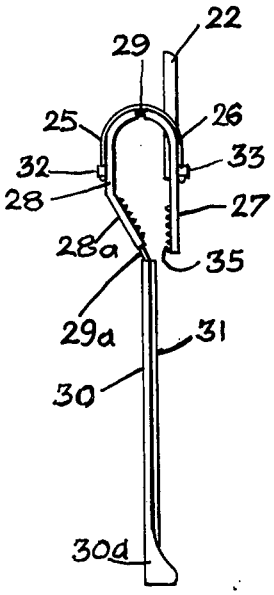
FIG. 2 is a right side and view in elevation of FIG. 1.
Figure 3:
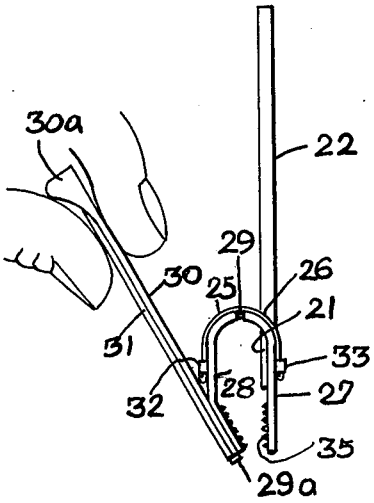
FIG. 3 is a view in elevation of the clamp of FIG. 2 in partial open position.
Figure 4:
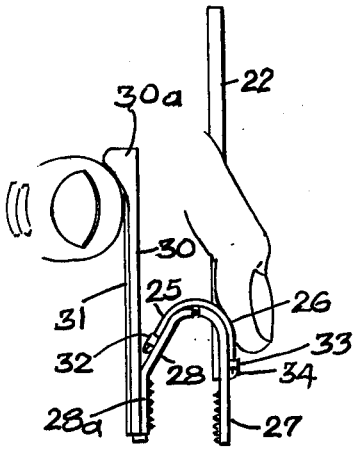
FIG. 4 is a view of FIG. 3 but in fully opened position.
Figure 5:
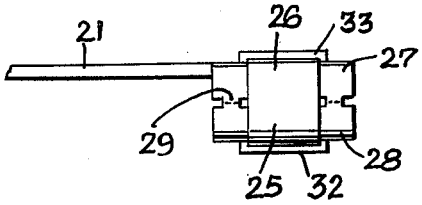
FIG. 5 is a plan view of the right side clamp and spring of FIG. 1.

In operation, hinged tab 29 is raised to an intermediate position as at finger engagable portion 30*a* shown in FIGS. 2 and 3, and thereafter leverage effect of tab 30 by finger pressures as shown in FIG. 4 flexes the spring and opens up the gripping members against the bias of spring legs 25 and 26 for garment insertion. Thereafter, finger pressures are released and the hanger assumes the garment engaging or locking position shown in FIGS. 1 and 2.

The spring described is preferably formed of spring steel. Other elements of the hanger including arm 21, hinged gripping members 27 and 28 and hinged tab 30 are preferably integrally molded from any suitable plastic while the hinging elements are formed of webbing in the molding operation. Any suitable resin of limited resiliency may be used including polypropylene, polyethylene and nylon and thicknesses of parts are suitably selected.

Embodiment II

In embodiment II of the invention shown in FIGS. 6–8, modifications over embodiment I include the use of a flexible pull tab 36 to open the clamp from closed position and means for the maintenance of an open intermediate position against the compressive force of the spring legs 25 and 26 when fully open position is not required.

By reference to FIGS. 6 and 8 and on the inner faces of gripping members 28 and 27 adjacent web 29 and outside of the spring position are a pair of cooperating members preferably integrally molded with said gripping members and forming a tooth 37 curved in section and a receiving socket 38 therefor correspondingly curved in section. In closed position of gripping members 27 and 28, the tooth and socket are in fully engaged position as shown in FIGS. 6 and 7. In intermediate open position as effected by pull tab 36, resiliency of members 37 and 38 permit disengagement of tooth 37 from socket 38 with an outer wall of socket member 38 serving as a stop for the nib of tooth 37. For closure from said intermediate position, compressive finger pressure additional to the spring bias is applied to the gripping members for reengagement of tooth 37 and socket 38.

Of course, rigid tab 30 of embodiment I may be used instead of flexible tab 36 in embodiment II.

It is understood that corresponding parts and assemblies of all embodiments including embodiment III herein are interchangeable with each other and bear similar reference numerals.

Embodiment III

FIGS. 9 and 10 show a third embodiment of the invention modified over embodiment I wherein the spring legs 25 and 26 are extended and turned outwardly to form diverging ears for opening of the normally closed position of the clamp; wherein the outer faces of the gripping members 27 and 28 are recessed to receive said spring legs and ears; and wherein the retaining loops 32 and 33 are formed by cross pieces over said recesses to engage offset spring portions for attachment to the gripping members.

Thus spring legs 25 and 26 are extended and folded as at 39 and 40 to form diverging and projecting ear extensions 41 and 42, the spring parts sitting in aligned recesses 43 and 44 in front and rear gripping members 45 and 46 and on the outer faces thereof. The lower area of the folded sections of the spring legs are provided with transverse raised ribs 47 and 48 for engagement with transverse retaining cross pieces 49 and 50 on the outside of and across the recesses of gripping members 45 and 46 for attachment to the gripping members.

Moreover, ears 41 and 42 as shown are provided with reinforcing ribs 51 and 52 and with roughened finger-engaging areas 53.

The clamp of embodiment III is in normally closed position as in embodiment I and operation thereof is obvious for opening as by pressing diverging ears 41 and 42 together. The spring clip of embodiment III is preferably formed of spring steel.

It is to be noted that in the assemblage of the spring clip with the gripping members of embodiment I and II (FIG. 8) for positive non-separability, the outwardly and upturned edges 34 of spring arms 25 and 26 are force-fitted through loops 32 and 33. In embodiment III, the raised ribs 47 and 48 of spring extensions 41 and 42 are force-fitted through cross pieces 49 and 50 (FIG. 10).

It is understood that minor changes in the materials, integration and location of parts of the illustrated embodiments of the invention may be resorted to without departing from the spirit of the invention and the scope of the appended claims.

I claim:

1. A plastic garment hanger comprising an arm carrying at least one clamp integrally molded therewith, said clamp having first and second hinged gripping members of limited resiliency below the hinged area, one of said gripping members being in diverging relationship with the other at least adjacent the top, said gripping members being adapted for movement between a closed and locked article gripping position and an article releasing position, a spring clip having legs extending therefrom and in overlying engagement with said gripping members, means for nonslideable securing said clip and legs at opposite sides to each of said gripping members to hold said gripping members together in normally closed and locked position, and finger engageable means extending from each of said legs to separate each of said gripping members to an article releasing position against the compressive force of the clip.

2. A plastic garment hanger as set forth in claim 1 wherein the gripping members have recesses adapted to be in continuous alignment and wherein said spring clip and the legs thereof sit for engagement with the floors thereof.

3. A plastic garment hanger as set forth in claim 2 wherein the means for securing said clip and legs thereof comprises a retainer bar across each of the gripping member recesses.

4. A plastic garment hanger as set forth in claim 3 wherein the finger engagable means comprises upturned diverging ears extending from the lower edges of the clip legs, passing through said retainer bars and projecting above the tops of the gripping members.

5. A plastic garment hanger as set forth in claim 4 wherein the inner faces of said gripping members each have article retaining projections.

6. A plastic garment hanger as set forth in claim 1 wherein a hook is secured to said arm and spaced from said clamp.

* * * * *